US005478718A

United States Patent [19]

Verbeeck et al.

[11] Patent Number: 5,478,718

[45] Date of Patent: Dec. 26, 1995

[54] PREPARATION OF SILVER HALIDE TABULAR EMULSIONS IN THE PRESENCE OF NON-AQUEOUS POLAR APROTIC SOLVENTS AND/OR PROTIC SOLVENTS HAVING A DISSOCIATION CONSTANT SMALLER THAN THAT OF WATER

[75] Inventors: Ann Verbeeck, Begijnendijk, Belgium; Angel Millan, Nijmegen, Netherlands

[73] Assignee: AGFA-Gevaert, N.V., Mortsel, Belgium

[21] Appl. No.: 374,178

[22] Filed: Jan. 18, 1995

[51] Int. Cl.[6] ..... G03C 1/015

[52] U.S. Cl. ..... 430/569; 430/567

[58] Field of Search ..... 430/569, 567

[56] References Cited

U.S. PATENT DOCUMENTS

| | | | |
|---|---|---|---|
| 3,871,887 | 3/1975 | Jones | 430/569 |
| 4,419,442 | 12/1983 | Falxa et al. | 430/569 |
| 4,725,534 | 2/1988 | Kagami et al. | 430/569 |
| 4,751,176 | 6/1988 | Pham | 430/569 |

*Primary Examiner*—Charles L. Bowers, Jr.

*Assistant Examiner*—Mark F. Huff

*Attorney, Agent, or Firm*—Breiner & Breiner

[57] ABSTRACT

A method has been found for the preparation of tabular silver halide emulsions having a tabularity, defined as the ratio between the aspect ratio and the thickness of the emulsion crystals, of at least 25 and a homogeniety of the distribution of said silver halide emulsion crystals, defined as a hundred times the ratio between the standard deviation and the average projective crystal diameter of said crystals of less than 30, characterized by the steps of forming silver halide grain nuclei by introduction of an aqueous silver salt solution and an aqueous halide salt solution, both solutions optionally comprising at least one non-aqueous solvent, in a reaction vessel containing water, a protective colloid and at least one non-aqueous aprotic solvent or a protic solvent having a dissociation constant smaller than that of water in a ratio by weight of solvent versus water from 5 to 60%; adding an aqueous silver salt solution and an aqueous halide salt solution to the said reaction vessel containing the said silver halide grain nuclei at a pBr value higher than 2.0; flocculating the grown silver halide emulsion grains; washing and redispersing them.

4 Claims, No Drawings

PREPARATION OF SILVER HALIDE TABULAR EMULSIONS IN THE PRESENCE OF NON-AQUEOUS POLAR APROTIC SOLVENTS AND/OR PROTIC SOLVENTS HAVING A DISSOCIATION CONSTANT SMALLER THAN THAT OF WATER

DESCRIPTION

1. Field of the Invention

The present invention relates to a preparation method of silver halide emulsions comprising tabular crystals.

2. Background of the Invention

The effects of various precipitation conditions on the formation of silver halide emulsions comprising tabular crystals have been studied extensively as the said tabular grains are known in the photographic art for quite some time. As early as 1961 Berry et al. described the preparation and growth of tabular silver bromoiodide grains in Photographic Science and Engineering, Vol 5, No 6. A discussion of tabular grains appeared in Duffin, Photographic Emulsion Chemistry, Focal Press, 1966, p. 66–72. Early patent literature includes U.S. Pat. Nos. 4,063,951; 4,067,739; U.S. Pat. Nos. 4,150,994; 4,184,877 and 4,184,878. However the tabular grains described herein cannot be regarded as showing a high diameter to thickness ratio, commonly termed aspect ratio. In a number of US applications filed in 1981 and issued in 1984 tabular grains with high aspect ratio and their advantages in photographic applications are described as e.g. in U.S. Pat. Nos. 4,434,226; 4,439,520; 4,425,425; 4,425,426 and 4,433,048. A survey on high aspect ratio silver halide emulsions appeared in Research Disclosure, Vol 225, January 1983, Item 22534.

The above cited references on tabular grains are mainly concerned with high sensitive silver bromide or silver iodobromide emulsions.

In U.S. Pat. No. 4,713,320 the important role of the protective colloid used during the precipitation of emulsions comprising tabular silver bromoiodide grains has been disclosed: the presence in the reaction vessel of oxidized gelatin, containing less than 30 micromoles of methionine per gram is of crucial importance. The degree of oxidation of the protective colloid can be used in order to control the tabularity of such grains. Otherwise it is generally known that the use of, e.g., phthalated gelatin as a protective colloid has a strong influence on the decrease of the percentage of the total projected area represented by said tabular grains.

From the patent literature and from our own experiments it can be concluded that the tabularity of tabular crystals, defined as the ratio between the aspect ratio and the thickness, is particularly controlled by the distance in the reaction vessel between the twin crystals during the nucleation step and by the pBr value during the growth step. A high tabularity within this concept requires a low pBr value as low pBr values are indispensible for the introduction of the anisotropic lateral growth of twin planes of the twinned nuclei formed during the nucleation step and for the stabilisation of the grown twin planes. However an excess of bromide ions results in a strong physical ripening and provides a heterogeneous size distribution.

Especially when a sensitometry with high gradations is requested one way to reach this is to decrease the degree of heterogeneity of the tabular grain size distribution. Different attempts for increasing homogeneity have been made as has been described in U.S. Pat. No. 4,801,522 by making use of the balanced double jet procedure and in U.S. Pat. No. 4,067,739 wherein accelerated flow double jet procedures with seed grains have been disclosed. Another method has been described in EP-A 421 740 wherein a high silver iodide content phase is present in the center of the grains and wherein the average aspect ratio remains less than 3. In U.S. Pat. No. 5,306,611 a preparation method has been described for twinned crystal monodispersed emulsions having an average aspect ratio of 5 or less. Another attempt has been described in EP-A 503 700, wherein lower aspect ratios are attained for the more monodisperse tabular grain population. To summarize: a higher degree of homogeneity is hitherto related with a lower aspect ratio of the tabular emulsion crystals.

Higher aspect ratios in combination with small grain size distributions for silver halide tabular grains can be obtained by the use of an ingredient as disodium propyleneoxy-polyoxyethylene disuccinate in the nucleation step as has been disclosed in U.S. Pat. No. 5,204,235. Another process of preparing a photographic emulsion containing tabular grains exhibiting a reduced degree of total grain dispersity has been given in U.S. Pat. Nos. 5,147,771; 5,147,772; 5,147,773; 5,171,659 and 5,252,453 wherein an alkylene oxide block copolymer surfactant is added during the parallel twin forming step.

Still another way consists in the use in the nucleation and/or subsequent steps of a water soluble polymer having nonionic groups other than low molecular weight gelatin as, e.g., derivatives of polyvinyl alcohol, polyvinyl pyrrolidone, polyvinyl imidazole, polyacrylamide or polymer having hydroxyquinolinethioether group as described in U.S. Pat. No. 5,215,879.

A preparation method wherein large tabular grains can be grown in less time and with narrower size distribution has been described in U.S. Pat. No. 5,318,888.

However an increasing degree of homogeneity is related with a decreasing aspect ratio for the tabular silver halide emulsion crystals.

OBJECTS AND SUMMARY OF THE INVENTION

It is an object of the present invention to find a new preparation method of silver halide photographic emulsions containing tabular silver halide grains showing a high aspect ratio, a high tabularity and a high degree of homogeneity.

Other objects will become apparent from the description hereinafter.

A method has been found for the preparation of tabular silver halide emulsions having a tabularity, defined as the ratio between the aspect ratio and the thickness of the emulsion crystals, of at least 25 and a homogeniety of the distribution of said silver halide emulsion crystals, defined as a hundred times the ratio between the standard deviation and the average projectile crystal diameter of said crystals of less than 30, characterized by the steps of forming silver halide grain nuclei by introduction of an aqueous silver salt solution and an aqueous halide salt solution, both solutions optionally comprising at least one non-aqueous solvent, in a reaction vessel containing water, a protective colloid and at least one non-aqueous aprotic solvent or a protic solvent having a dissociation constant smaller than that of water in a ratio by weight of solvent versus water from 5 to 60%.

adding an aqueous silver salt solution and an aqueous halide salt solution to the said reaction vessel containing the said silver halide grain nuclei at a pBr value higher than 2.0, flocculating the grown silver halide emulsion grains, washing and redispersing them.

This invention improves the production of tabular grains, which is normally carried out under conditions of very high excess of halide ions at pAg values higher than 10.0 or pBr values of about 1.0 to 1.5.

This invention further permits the production of emulsions in which tabular grains account for at least 50% of the projected area under conditions of a lower excess of halide ions.

DETAILED DESCRIPTION OF THE INVENTION

As there has nothing been found in patent literature about the preparation of tabular silver halide grains in solvents other than water, it has unexpectedly been found that the use of non-aqueous protic solvents, in the presence of water and/or polar aprotic or protic solvents having a dissociation constant smaller than that of water is in favour to reach the objects of this invention, provided that the excess of halide ions is such that a pBr of not less than 2.0 is allowed during precipitation. The presence of polar aprotic solvents and/or alcohols in an aqueous precipitating medium with a reduced excess of halide ions has two effects:

(1) an increase of the relative number and/or an increase of the total projected area of the desired tabular grains (2) an increase of the size of the tabular grain populations without any relevant change in their thickness which is equivalent with an increased tabularity.

The combination of an increase of the said tabularity of the emulsion, defined as the ratio between the aspect ratio and thickness of the tabular grain, as well as an increase of the degree of homogeneity for the silver halide grain distribution is an essential feature of this invention. Preferred aspect ratios for silver halide crystals prepared according to the method of this invention are in the range of at least 8:1 up to 100:1.

The production in a normally used aqueous gelatinous medium of tabular crystals by double jet methods is based on the presence of a very high excess of bromide ions in the bulk of the precipitating medium in one or more stages of the precipitation. Typically, the molar content of bromide ion in the bulk of the solution vessel is about seven orders higher than that of silver ion in the solution when tabular silver bromide crystals are precipitated.

The method to prepare tabular silver halide crystals is based on the use of polar aprotic and/or protic solvents, the dissociation constant of which is smaller than that of water. The presence of water in the precipitation vessel is thereby not excluded. Solvents having a dissociation constant smaller than that of water are, e.g. alcohols, wherein at least one alcohol is used in the dispersion medium. Preferred alcohols are methanol and ethanol.

According to this invention in a preferred embodiment the dispersion medium contains 5 to 60% by weight of polar protic solvents, such as the said alcohols.

The precipitate can be separated by decantation and (ultra) filtration, washed and stored for further use. An advantage in comparison with emulsion preparation in aqueous gelatinous medium is that, due to the use in the preparation step of a lower excess of halide salts, lower amounts of water are required during the washing step.

As has been set forth above, according to this invention halide ions are present in excess in each stage of the precipitation. In order to prepare silver bromoiodide, silver chlorobromide, silver chlorobromoiodiode, silver chloride, silver chloroiodide or silver iodide tabular crystals, according to this invention, the necessary chloride and/or bromide and/or iodide ions are added. It is specifically contemplated that in the precipitation of silver bromoiodide emulsions up to 10 mole percent of iodide ions, and more preferably up to 3 mole percent can be incorporated in the silver bromide tabular grains of the present invention. This can be achieved by mixing a soluble bromide and a soluble iodide salt in one or more of the halide solutions up to the desired mole % concentrations required in each preparation step or by a triple jet technique, or separate addition of an iodide containing aqueous solution. Due to the lower solubility of iodide ions in comparison with bromide ions, said iodide ions are able to displace bromide ions from the grain, a technique known in the art as conversion. Iodide ions may also be incorporated into the silver halide crystal lattice by the addition of a previously prepared silver iodide fine-grained Lippmann emulsions, composed of either pure silver iodide or mixed halides. Iodide ions can be provided by inorganic iodide salts and/or organic compounds releasing iodide ions as has e.g. been described in EP-Applications 561 415, 563 701 and 563 708.

Two or more types of tabular silver halide emulsions having a different composition or the same but having been prepared differently can be mixed for forming a photographic emulsion for use in a silver halide photographic material.

The different steps of the precipitation can be alternated by physical ripening steps or by so called "neutralization steps", during which the pAg value is changed to a value required in the next growth stage by adding an amount of silver nitrate solution or a water soluble halide salt within a well-defined time of addition by means of the single-jet technique. Alternative ways to regulate the pAg to the desired value before continuing the processing are diluting the emulsion present in the reaction vessel, diafiltration or ultrafiltration and even flocculation and washing procedures, the last techniques being preferred to concentrate the emulsion crystals in the reaction vessel.

The average aspect ratio is preferably more than 5, and preferably more than 8, in order to obtain a tabularity of at least 25 and more preferably more than 50.

During the growth step(s) an increasing flow rate of silver and halide solutions is preferably applied, e.g. a linearly increasing flow rate. Typically the flow rate at the end is about 3 to 10 times greater then at the start of the growth step. For the succesful preparation of tabular grains according to the present invention the pBr before the start and during the different stages of the precipitation is maintained at a well-defined value as will become apparent from the examples hereinafter.

The invention is further compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step, i.a., under conditions that are conducive to twinning. The second approach is to form a stable grain population and then adjust the pAg of the interim emulsion to a level conducive to twinning. However it is recommended to introduce the twin planes in the grain nuclei at an early stage of precipitation. So it is contemplated to obtain a grain nuclei population parallel twin planes using less than 2% of the total silver used to form the tabular grain emulsion. Although this can be accomplished using even less than 0.05% of the total silver to form parallel twin planes, it is usually convenient to use at least said amount of 0.05% in order to form the twin plane containing grain nuclei population. The longer the introduction of parallel twin planes is delayed after forming a stable grain nuclei population the greater is the tendency towards increased grain dispersity. Application of the method according to this invention therefor offers a good compromise between a limited excess of halide ions and the presence of non-aqueous polar aprotic solvent and/or polar protic solvent having a dissociation constant lower than that of water in a ratio by weight of solvent versus water from 5 to 60% in favour of the homogeneity of the silver halide grain distribution.

The photographic emulsions comprising silver halide tabular crystals, according to the present invention, may have a homogeneous or a heterogeneous halide distribution within the crystal volume. A heterogeneous halide distribution may be obtained by application of growth steps having a different halide composition or by conversion steps, e.g., by addition of halide ions that provide less soluble silver salts, onto existing tabular cores. In the case of a heterogenous distribution of halide ions a multilayered grain structure is obtained. Obviously the tabular form has to be maintained in this case, in order to get tabular emulsion crystals in accordance with this invention.

In accordance with this invention wherein polar aprotic solvents are used or protic solvents having a dissociation constant smaller than that of water, the homogeneity of the distribution of the tabular silver halide emulsion crystals obtained, said "homogeneity" defined as hundred times the ratio between the standard deviation and the average projectile crystal diameter of said crystals, is less than about 30, and more preferably less than 20.

In the preparation of emulsions according to the present invention a protective colloid is required. There is no need however for the use of a special oxidized gelatin or the presence of a synthetic peptizer. Conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium.

Although gelatin is commonly used as a protective colloid, the presence of silica sol is not excluded. Moreover, in order to reduced pressure marks in materials wherein silver halide tabular grains, prepared according to this invention are used, silica sol as a protective colloid is even recommended as a protective colloid, whether or not together with gelatin.

Irrespective of the fact whether gelatin or silica or a combination of both is used as a protective colloid tabular silver halide emulsions in connection with the present invention can further be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur, selenium or tellurium, e.g., thiosulphate, thiocyanate, thioureas or the corresponding selenium and/or tellurium compounds, sulphites, mercapto compounds, and rhodamines. The emulsions may be sensitized also by means of gold-sulphur, gold-selenium or gold-tellurium ripeners or by means of reductors e.g. tin compounds as described in GB Patent 789,823, amines, hydrazine derivatives, formamidine-sulphinic acids, and silane compounds.

The tabular silver halide emulsions may be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosure Item 22534.

In classical emulsion preparation spectral sensitization traditionally follows the completion of chemical sensitization. However, in connection with tabular grains, it is specifically considered that spectral sensitization may occur simultaneously with or may even precede completely the chemical sensitization step: the chemical sensitization after spectral sensitization is believed to occur at one or more ordered discrete sites of tabular grains.

Additional gelatin may be added in any further preparation step before coating in order to establish optimal coating conditions and/or to establish the required thickness of the coated emulsion layer. Preferably a gelatin to silver halide ratio ranging from 0.3 to 1.0 is then obtained.

As a result in a further stage after the end of the precipitation and desalting step of the silver halide emulsion, followed by chemically ripening, whether or not in the presence of spectral sensitiser(s) an emulsion is obtained that can be prepared for coating in light-sensitive photographic layers of silver halide photographic materials after the addition of the well-known ingredients, as, e.g. stabilisers, surface-active agents, hardening agents, antistatic agents, filter dyes, development accelerators, compounds improving the dimensional stability of the photographic element, UV-absorbers, spacing agents and plasticizers, etc., as summarised in Research Disclosure 36554, September 1994, p. 501–541.

The photographic tabular grains in connection with the present invention can be used in various types of photographic elements, e.g. black and white silver halide photographic materials, like materials used for X-ray diagnostic purposes, materials for micrography, duplicating materials, colour sensitive materials, etc., and can be coated on suitable supports in the required layer arrangements adapted to each application.

The following examples illustrate the invention without however limiting it thereto.

EXAMPLES

Example 1

Preparation of comparative emulsion No. 1.

As a control emulsion silver bromide emulsion 1 was prepared as described hereafter. Following solutions were prepared:

433 ml of a dispersion medium (C) containing 0.05 mole/l of potassium bromide and 5.77 g/l of gelatin; temperature was established at 50° C.;

a 1.94 molar silver nitrate solution (A);

a 1.94 molar potassium bromide solution (B).

A nucleation step was performed by introducing solution A and solution B simultaneously into dispersium medium C both at a flow rate of 12.2 ml/min during 28 seconds.

During the following physical ripening stage of 20 minutes the temperature was raised to 70° C. and 95 ml of water containing 9.5 g of gelatin were added.

Then, crystal growth was performed by introducing by a double jet during 4 min solution A at a constant flow rate of 1.5 ml/min and solution B as to maintain a constant silver potential measured by a silver electrode versus a silver/silver chloride reference electrode of +18 mV.

A second growth step was performed by introducing by a double jet during 76 min solution A starting at a flow rate of 1.5 ml/min and linearly increasing the flow rate to an end value of 7.5 ml/min and solution B at an increasing flow rate in order to maintain a constant potential of +18 mV.

Finally the emulsion was concentrated and washed by an ultrafiltration technique.

Water is the only solvent used in this comparative preparation.

Preparation of inventive emulsion No. 2.

A second silver bromide emulsion (emulsion No. 2) was prepared in a way similar to control emulsion No. 1 with the following modification: 5% by weight aqueous solution of acetonitrile was used instead of pure water in the preparation of the dispersion medium.

Example 2

Preparation of comparative emulsion No. 3.

A control emulsion No. 3 was prepared in the following way: The following solutions were prepared:

433 ml of a dispersion medium (C) containing 0.01 mole/l of potassium bromide and 5.77 g/l of gelatin; temperature was established at 50° C.;

a 1.94 molar silver nitrate solution (A);

a 1.94 molar potassium bromide solution (B).

A nucleation step was performed by introducing solution A and solution B simultaneously into dispersion medium C both at a flow rate of 6 ml/min during 60 seconds. During the following physical ripening stage of 20 min the temperature was raised to 70° C.. Then, crystal growth was performed by introducing by a double jet during 30 min solution A starting at a flow rate of 1.5 ml/min and linearly increasing the flow rate to an end value of 3.5 ml/min and solution B at an increasing flow rate in order to maintain constant the silver potential measured at the end of the ripening stage.

Finally the emulsion was concentrated and washed by an ultrafiltration technique.

Water is the only solvent used in this comparative preparation.

Preparation of inventive emulsion No. 4.

A fourth silver bromide emulsion (emulsion No. 4) was prepared in a way similar to control emulsion 3 with the following modification: 25% by weight of a solution of DMSO in water was used instead of pure water in the preparation of the dispersion medium.

Preparation of inventive emulsion No. 5.

A fifth silver bromide emulsion (emulsion No. 5) was prepared in a way similar to control emulsion No. 3 with the following modification: 20% by weight of a solution of acetone in water was used instead of pure water in the preparation of the dispersion medium.

Preparation of inventive emulsion No. 6.

A sixth silver bromide emulsion (emulsion No. 6) was prepared in a way similar to control emulsion No. 3 with the following modification: 20% by weight of a solution of ethanol in water was used instead of pure water in the preparation of the dispersion medium.

Preparation of inventive emulsion No. 7.

A seventh silver bromide emulsion (emulsion No. 7) was prepared in a way similar to control emulsion No. 3 with the following modification: 50% by weight of a solution of ethanol in water was used instead of pure water in the preparation of the dispersion medium.

The grain size characteristics of emulsion samples No. 1 to No. 7 are summarized in table 1.

In Tables 1 and 2 the abreviations have the following meaning.

1: % t. gr.: frequency percentage of tabular grains present in the entire grain population deduced from electron photomicrography;

2: $d_s^{\#}$: average sphere-equivalent diameter of the tabular grain fraction, the sphere-equivalent diameter being defined as the diameter of the hypothetical spherical grain with the same volume as the actual tabular grain;

3: $d_{EM}$: average electron microscopic diameter of the tabular grain fraction, the electron microscopic diameter being defined as the diameter of a circle having an area equal to the projected area of the actual tabular grain as viewed on an electron photomicrograph;

4: th: average thickness of the tabular grain fraction as deduced from electron photomicrography;

5: AR: average aspect ratio of the tabular grain fraction, defined as the average electron microscopic diameter of the tabular grain fraction divided by the average thickness of the tabular grain fraction as deduced from electron photomicrography;

6: VAR: variance for the distribution of the tabular grains: ratio between standard deviation, calculated for each grain and the average projective area of calculated for the whole grain size distribution, multiplied by 100, in order to obtain a procentual figure.

7: PA: percentage of the total projected area accounted for by the tabular grain fraction deduced from electron photomicrography.

TABLE 1

| Em. No. | (% t.gr.)[1] | $(d_s^{\#})^2$ | $(d_{EM})^3$ | (th)[4] | (AR)[5] | (VAR)[6] |
|---|---|---|---|---|---|---|
| em. 1 | 54.2 | 0.70 | 1.51 | 0.10 | 15.1 | 52% |
| em. 2 | 55.5 | 1.00 | 2.29 | 0.13 | 17.62 | 29% |

As can be concluded from Table 1, the variance VAR clearly decreases in the presence of 5% by weight of a solution of ACN in water, although the aspect ratio is increased.

From Table 2 hereinafter, it can be concluded that in critical conditions there is a trend to produce larger tabular crystals. By the method according to this invention at least 50% of the projected area is clearly accounted for by tabular grains.

TABLE 2

| Em. No. | $(d_s^{\#})^2$ | $(d_{EM})^3$ | (th)[4] | (AR)[5] | (PA)[7] |
|---|---|---|---|---|---|
| em. 3 | 0.46 | 0.74 | 0.10 | 7.40 | 25 |
| em. 4 | 0.65 | 1.35 | 0.09 | 15.00 | 81 |
| em. 5 | 0.69 | 1.52 | 0.09 | 16.89 | 51 |

TABLE 2-continued

| Em. No. | $(d_s^{\#})^2$ | $(d_{EM})^3$ | $(th)^4$ | $(AR)^5$ | $(PA)^7$ |
|---|---|---|---|---|---|
| em. 6 | 0.64 | 1.21 | 0.08 | 15.13 | 53 |
| em. 7 | 0.88 | 2.11 | 0.09 | 23.44 | 89 |

As a consequence we can summarise that by the preparation method according to this invention described hereinbefore a breakthrough in the relationship between homogeneity and tabularity has been realised. An increase of the tabularity of tabular grains henceforth doesn't mean a decrease in homogeneity anymore.

We claim:

1. Method of preparing tabular silver halide emulsions having a tabularity, defined as a ratio between aspect ratio and thickness of emulsion crystals, of at least 25 and homogeneity of distribution of said silver halide emulsion crystals, defined as a hundred times a ratio between the standard deviation and average projective crystal diameter of said crystals of less than 30, characterized by the steps of forming silver halide grain nuclei by introduction of an aqueous silver salt solution and an aqueous halide salt solution, both solutions optionally comprising at least one non-aqueous solvent, in a reaction vessel containing water, a protective colloid and at least one non-aqueous aprotic solvent selected from the group consisting of acetone, dimethylsulfoxide and acetonitrile or a protic solvent selected from the group consisting of methanol and ethanol, having a dissociation constant smaller than that of water in a ratio by weight of solvent versus water from 5 to 60%, adding an aqueous silver salt solution and an aqueous halide salt solution to said reaction vessel containing silver halide grain nuclei at a pBr value higher than 2.0, flocculating grown silver halide emulsion grains, washing and redispensing.

2. Method according to claim 1, wherein the total projective area of said emulsion crystals accounted for by the tabular grains is at least 50%.

3. Method according to claim 1, wherein said tabular silver halide emulsions are silver bromide, silver bromoiodide, silver chlorobromoiodide, silver chlorobromide, silver chloroiodide or silver chloride emulsions.

4. Method according to claim 1, wherein said protective colloid is gelatin and/or silica.

* * * * *